US011293161B2

(12) United States Patent
Von Handorf et al.

(10) Patent No.: US 11,293,161 B2
(45) Date of Patent: Apr. 5, 2022

(54) RETAINING WALL

(71) Applicant: Nivo Holdings, LLC, Bellbrook, OH (US)

(72) Inventors: Jeffrey J. Von Handorf, Waynesville, OH (US); Tommy E. Nicholson, Bellbrook, OH (US)

(73) Assignee: Structure Sight LLC, Dayton, OH (US)

( * ) Notice: Subject to any disclaimer, the term of this patent is extended or adjusted under 35 U.S.C. 154(b) by 0 days.

(21) Appl. No.: 16/986,446

(22) Filed: Aug. 6, 2020

(65) Prior Publication Data

US 2021/0040704 A1 Feb. 11, 2021

Related U.S. Application Data

(60) Provisional application No. 62/883,722, filed on Aug. 7, 2019.

(51) Int. Cl.
*E02D 29/02* (2006.01)

(52) U.S. Cl.
CPC ..... *E02D 29/0266* (2013.01); *E02D 29/0225* (2013.01); *E02D 2600/20* (2013.01)

(58) Field of Classification Search
CPC . E02D 29/02; E02D 29/0225; E02D 29/0233; E02D 29/0258; E02D 29/0266
USPC ..... 405/262, 284, 285, 286
See application file for complete search history.

(56) References Cited

U.S. PATENT DOCUMENTS 3,381,483 A * 5/1968 Huthsing, Jr. ..... E02B 3/066 405/262
3,869,868 A * 3/1975 Irsai ..... E02D 29/0266 405/285
4,050,254 A * 9/1977 Meheen ..... E02D 29/0266 405/285
4,384,810 A * 5/1983 Neumann ..... E01F 8/024 405/284
4,407,612 A * 10/1983 van Weele ..... E02D 5/20 405/284
4,572,711 A * 2/1986 Benson ..... E02D 29/0266 405/273
4,668,129 A * 5/1987 Babcock ..... E02D 29/0266 405/284
4,684,294 A * 8/1987 O'Neill ..... E02D 29/0266 405/273
4,804,299 A * 2/1989 Forte ..... E02D 29/0241 405/262
4,887,691 A * 12/1989 Rotondo ..... E02D 27/42 181/210
4,993,872 A 2/1991 Lockwood
5,030,035 A * 7/1991 Babcock ..... E02D 29/0216 405/262
6,371,699 B1 * 4/2002 Weinreb ..... E02D 29/0233 405/262

(Continued)

*Primary Examiner* — Frederick L Lagman
(74) *Attorney, Agent, or Firm* — Stevens & Showalter LLP

(57) ABSTRACT

A retaining wall comprising at least first and second elongated framing posts laterally spaced from each other, each framing post including an edge defining a slot area. A side frame extends from a rear side of each framing post. At least one wall panel is positioned between the first and second framing posts, wherein the at least one wall panel includes opposing first and second lateral edges, each lateral edge positioned in a respective slot area of one framing post.

11 Claims, 7 Drawing Sheets

(56) References Cited

U.S. PATENT DOCUMENTS

| | | | | |
|---|---|---|---|---|
| 6,851,889 | B2 * | 2/2005 | Buchanan | E02B 3/06 256/13 |
| 7,001,110 | B2 | 2/2006 | Lockwood | |
| 7,303,358 | B1 * | 12/2007 | Fuller | E02B 7/22 256/31 |
| 9,951,493 | B2 | 4/2018 | Heraty | |
| 10,087,598 | B1 * | 10/2018 | Babcock | E02D 29/025 |
| 10,280,583 | B2 * | 5/2019 | Babcock | E02D 29/025 |
| 10,337,164 | B2 * | 7/2019 | Babcock | E02D 29/0266 |
| 10,400,418 | B2 * | 9/2019 | Babcock | E02D 29/025 |
| 2012/0076594 | A1 * | 3/2012 | Park | E02D 5/02 405/285 |
| 2019/0203441 | A1 * | 7/2019 | Jaecklin | E02D 29/0233 |

* cited by examiner

RETAINING WALL

CROSS REFERENCE TO RELATED APPLICATION

This application claims the benefit of U.S. Provisional Patent Application Ser. No. 62/883,722, filed Aug. 7, 2019, entitled "RETAINING WALL," the entire disclosure of which is incorporated by reference herein.

FIELD

The present invention is generally directed to a retaining wall and, more particularly, is directed to a modular construction and anchor system for a retaining wall.

BACKGROUND

Retaining walls are stabilizing structures that can be used for holding back earth. Generally, such retaining walls must provide stability against pressures exerted against a back side of the retaining wall by back fill soil.

U.S. Pat. No. 7,001,110 discloses a precast concrete retaining wall that forms a wing wall and is supported by a concrete footer with precast anchor members projecting laterally from the wing wall into back-filled soil behind the wing wall. The anchor members may be attached to the wing wall by reinforcing rods within the anchor member that connect with the wing wall. The reinforcing rods within the anchor member can include means for attaching the anchor member at the construction site after separately precasting the anchor member and wing wall.

U.S. Pat. No. 9,951,493 discloses a prefabricated retaining wall structure, wherein the structure has a precast concrete face panel and an elongated support column permanently joined to the face panel. The support columns can be positioned into recesses formed in a foundation to support the face panel.

There is a need for a retaining wall structure that can be easily transported as components to a construction site where the wall structure may be assembled, wherein the design of the structure can accommodate different retaining wall heights to provide a stable retaining wall structure.

SUMMARY

In accordance with an aspect of the invention, a retaining wall is provided comprising at least first and second elongated framing posts laterally spaced from each other, each framing post including an edge defining a slot area. A side frame extends from a rear side of each framing post. At least one wall panel is positioned between the first and second framing posts, wherein the at least one wall panel includes opposing first and second lateral edges, each lateral edge positioned in a respective slot area of one framing post.

The lateral edges of the at least one wall panel may be slidably located in the respective slot areas of the framing posts.

The framing posts may be formed with an I-beam configuration.

The framing posts may be formed with a T-beam configuration.

Each side frame may include an anchor frame opposite from a side frame front end connected to a respective framing post, and an anchor panel extending between and engaged with each of the anchor frames connected to respective adjacent framing posts.

Each anchor frame may include an elongate slot area, and the anchor panel may include opposing lateral edges slidably engaged within a respective slot area of an anchor frame.

The anchor panel may be supported to angle outwardly from the framing posts, as the anchor panel extends in an upward direction.

The side frame may be formed integrally with a respective framing post.

The side frame and framing post may be formed as a unitary concrete structure.

The side frame may be detachably attached to a respective framing post.

The side frame and framing post may be formed as a steel structure.

The side frame and framing post may be formed of a composite material.

The side frame and framing post may be formed of different materials.

The different materials may comprise two or more of concrete, steel, and a composite material.

In accordance with another aspect of the invention, a retaining wall is provided comprising at least first and second vertically extending framing posts laterally spaced from each other, each framing post including an edge defining an elongated slot area. A side frame extends from a rear side of each framing post. An anchor frame is attached to an end of each side frame distal from a respective framing post, and each anchor frame includes an edge defining an elongated slot area. At least one wall panel extends between adjacent framing posts, each wall panel including opposing lateral edges. Each lateral edge of the at least one wall panel is slidably located in a slot area of a respective framing post. An anchor panel extends between adjacent anchor frames, each anchor panel including opposing lateral edges. Each lateral edge of the anchor panel is slidably located in a slot area of a respective anchor frame.

Each side frame may include a lower side and an upper side, and the anchor panel may be supported to angle outwardly from the framing posts as the anchor panel extends in an upward direction from the lower side to the upper side of a respective side frame.

The slot areas in the framing posts may be defined by a front side and a rear side connected by a central web to define an I-beam configuration for the slot areas of the framing posts slidably receiving the lateral edges of the at least one wall panel.

The slot areas in the anchor frames may be defined by a front side and a rear side connected by a central web to define an I-beam configuration for the slot areas of the anchor frames slidably receiving the lateral edges of the anchor panel.

The slot areas in the framing posts may be defined by a front side connected to a rearward extending central web to define a T-beam configuration for the slot areas of the framing posts slidably receiving the lateral edges of the at least one wall panel.

The slot areas in the anchor frames may be defined by a front side connected to a forward extending central web to define a T-beam configuration for the slot areas of the anchor frames slidably receiving the lateral edges of the anchor panel.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
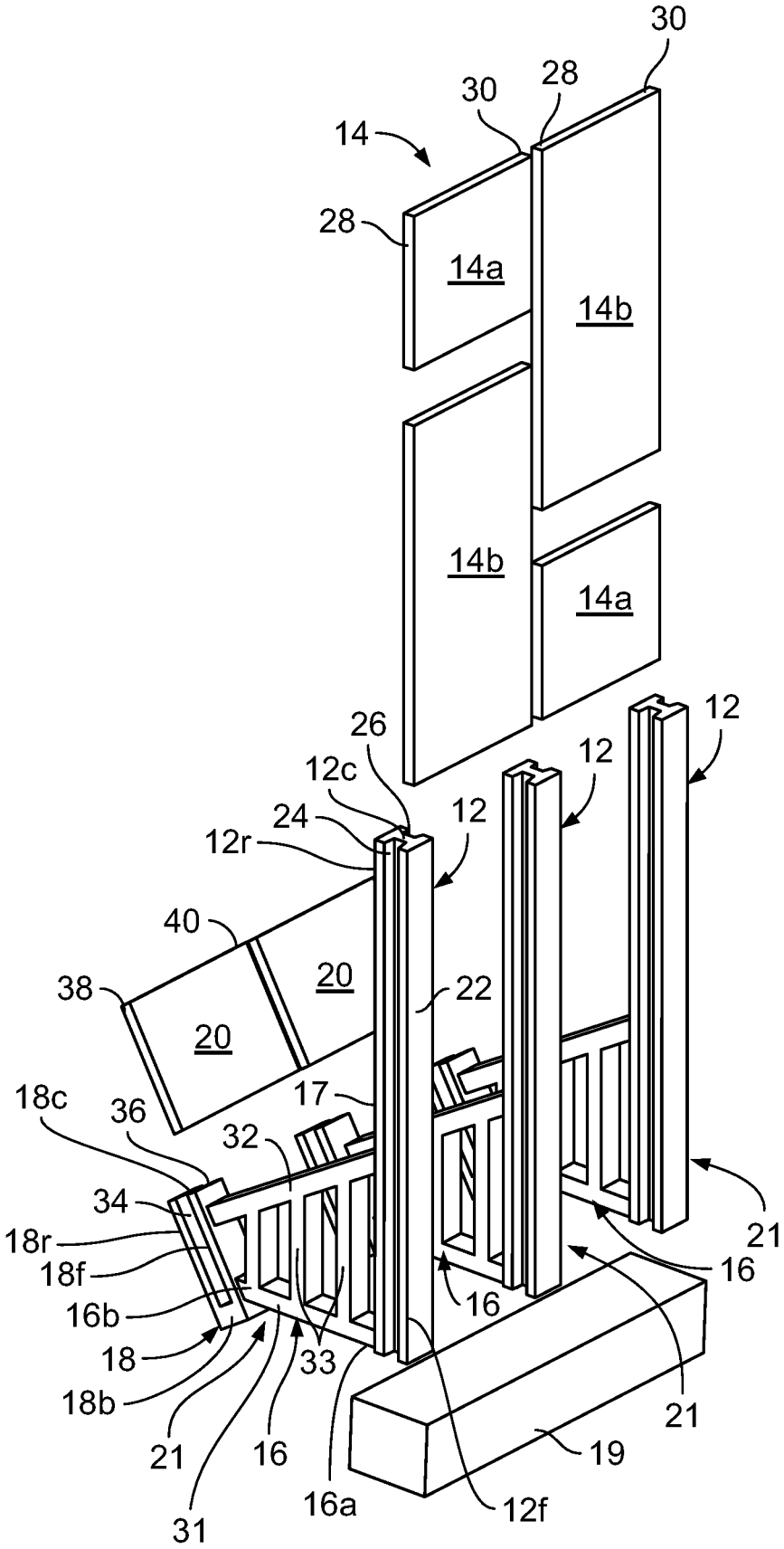
FIG. 1 is an exploded perspective view illustrating components of a system for forming a retaining wall.

The retaining wall 10 described herein is formed as a modular structure that can be assembled from individual components, such as may be shipped on a truck to a site for installation. Referring to FIG. 1, the components forming the retaining wall 10 comprise elongated framing posts 12 forming a support structure or frame for supporting one or more wall panels 14. The framing post 12 includes or is connected to a side frame 16 that extends from a rear side 17 of the framing post 12. The side frame 16 includes a front end 16*a* at its connection to the framing post 12. A rear end 16*b* of the side frame 16, distal from the framing post 12, supports an anchor frame 18. The anchor frame 18 is configured to support an anchor panel 20, as is described in further detail below. The framing post 12, side frame 16, and anchor frame 18 form a framing post assembly 21.

It should be understood that the side frame 16 and anchor frame 18 may be formed as a separate component, e.g., a separate poured component, that may be detachably bolted, or otherwise attached, onto a separately formed framing post 12, Alternatively, the side frame 16 and anchor frame 18 may be formed as separate components that can be detachably bolted, or otherwise attached, together and attached to a separately formed framing post 12.

The retaining wall 10 includes at least first and second laterally spaced framing posts 12 that are preferably supported on a footer 19, and may contain any number of a plurality of framing posts 12 that are spaced laterally from one another. The framing posts 12 are configured to extend vertically and have a length that generally defines a height of the retaining wall 10, Each framing post 12 can comprise an outwardly facing front side 22 and opposing lateral edges defining elongated slot areas 24, 26. The slot areas 24, 26 extend the entire length, or substantially the entire length, of the framing posts 12. In the embodiment illustrated in FIGS. 1 and 2 the slot areas 24, 26 are defined as slots having a front side 12*f* and a rear side 12*r* connected by a central web 12*c*, i.e., comprising 'closed' slots, forming an I-beam configuration for the framing post 12, although other configurations of the slot areas may be provided, such as is described further below with reference to FIGS. 7 and 8.

Figure 2:
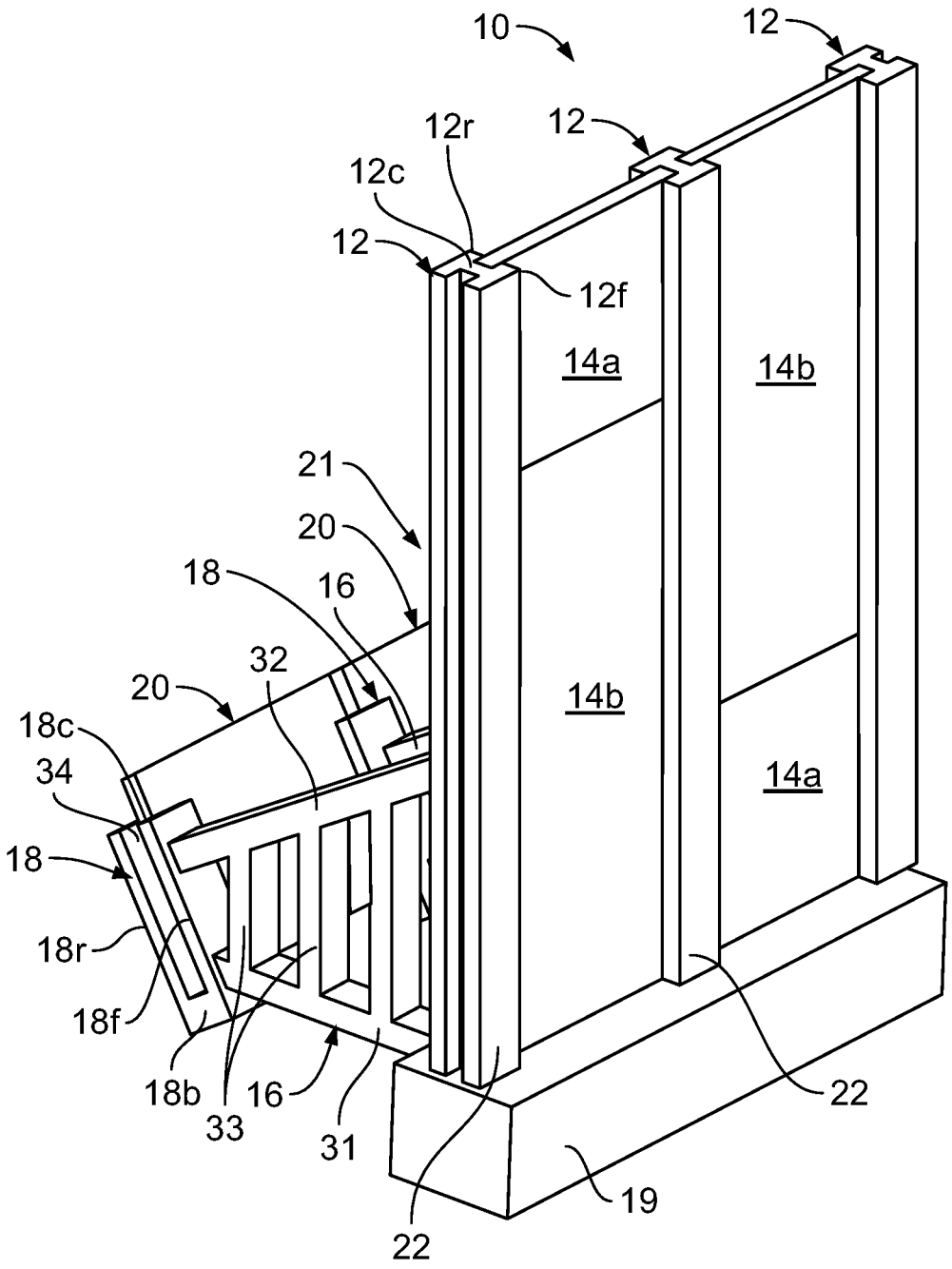
FIG. 2 is a front perspective view of an assembled retaining wall using the system of FIG. 1.

As seen in FIG. 1, the wall panels 14 are configurated to span laterally between adjacent framing posts 12 and include opposing lateral edges, or edge portions, 28, 30 sized to slidably fit within the elongated slot areas 24, 26. As seen in FIG. 2, the wall panels 14 may be formed with a height that is less than the height of the framing posts 12. Further, wall panels 14 having different heights may be provided for forming the retaining wall 10, as is illustrated by the different height wall panels 14*a*, 14*b* in FIGS. 1 and 2, wherein the differing height wall panels 14*a*, 14*b* may be alternately stacked on top of one another to form up a vertically extending section of the retaining wall 10.

The side frame 16 can be formed integral with the framing post 12, or may be rigidly attached to the framing post 12, e.g., by bolting to the framing post 12, and can be formed as a generally quadrilateral structure having a lower side 31 that may be generally perpendicular to the framing post 12, and a declining upper side 32, extending downwardly toward the lower side 31 and rearwardly from the framing post 12. The side frame 16 can additionally include one or more support web members 33 extending between the lower and upper sides 31, 32. The anchor frame 18 can be supported at an angle relative to the framing post 12, i.e., at an angle relative to vertical, extending upwardly away from the framing post 12, i.e., extending upwardly from the lower side 31 toward the upper side 32. The anchor frame 18 includes opposing lateral edges defining elongated slot areas 34, 36 extending the entire length, or substantially the entire length, of the anchor frames 18. The slot areas 34, 36 may be defined as slots having a front side 18*f* and a rear side 18*r* connected by a central web 18*c*, i.e., comprising "closed" slots, forming an beam configuration for the anchor frame 18, see FIG. 1, although other configurations of the slot areas may be provided, as is described further below. The anchor panels 20 are configurated to span laterally between adjacent anchor frames 18 and include opposing lateral edges, or edge portions, 38, 40 sized to slidably fit within the elongated slot areas 34, 36. The anchor panels 20 may rest on a base 18*b*' at the bottom of the slot areas 34, 36.

Referring to FIG. 2, in assembling the retaining wall 10, a plurality of the framing post assemblies 21 can be positioned in laterally spaced relation on the footer 19. Wall panels 14 can be positioned within the spaces between the framing posts 12, e.g., between first and second framing posts 12, by engaging the lateral edge portions 28, 30 within the slot areas 24, 26 of the framing posts 12 at the upper ends of the framing posts 12 and sliding the wall panels 14 downward toward the footer 19. Similarly, the anchor panels 20 can be positioned within the spaces between the anchor frames 18 by engaging the lateral edge portions 38, 40 within the slot areas 34, 36 of the anchor frames 18, at upper ends of the anchor frames 18, and sliding the anchor panels 20 downward.

It should be understood that a bin-like structure is defined by the side frames 16 and anchor panels 20, extending rearward from the frame portions 12 and wall panels 14, wherein the area within the bin-like structure can be filled with dirt or other fill material to form an anchor for preventing the assembled wall structure from tilting or tipping.

In particular, the angled anchor panels 20 provide an outward angled surface for the weight of the filler material to apply a vertical force to resist forward tipping of the assembled wall structure. The rearward extending side frames 16 also resist rearward tipping of the assembled wall structure. Further, the outward angled configuration of the anchor panels 20 enables formation of a reduced excavation area behind the wall panels 14, i.e., by reducing the footprint or base area that needs to be excavated for receiving the rearward extending side frames 16, resulting in a reduced excavation cost to install the retaining wall 10.

It should also be noted that the length of the side frames 16, extending rearward from the framing posts 12, can vary. For example, a selected length of the side frames 16 can be increased or decreased depending on the soil stability. Additionally, the length of the side frames 16 can vary in proportion to the height of the framing posts 12, wherein the length of the side frames 16 can increase or decrease with increasing or decreasing height, respectively, of the framing posts 12. Also, the height of the side frames 16 can increase with increasing length of the side frames 16 and/or increasing height of the framing posts 12. Hence, in providing the retaining wall 10 as a system for installation, the amount of excavation required for preparing a site for receiving the retaining wall 10 can be decreased as the height of the wall decreases.

The retaining wall 10 described herein is not limited to a particular material for forming the components making up the assembled wall structure. For example, the framing post assemblies 21 may be formed as unitary concrete structures, such that fasteners may be substantially avoided in assembly of the retaining wall 10. In such an assembly, the wall panels 14 and/or the anchor panels 20 may also be formed of concrete or of another material. Further, the framing post assemblies 21, the wall panels 14 and the anchor panels 20 may be formed of other materials including, without limitation, steel and composite materials. Also, it may be understood that the components forming the retaining wall 10 need not be formed of the same materials, wherein the framing post assemblies 21 may be formed of one or more materials and the wall panels 14 and/or the anchor panels 20 may be formed of one or more different materials. Also, the framing post assemblies 21 may be formed of two or more different materials, wherein the framing post 12 and the side frame 16, and/or the anchor frame 18, may be formed of different materials such as, without limitation, two or more of concrete, steel, and a composite material.

Exemplary alternative configurations for the retaining walls having different heights are illustrated in FIGS. 3-6.

Figure 3:
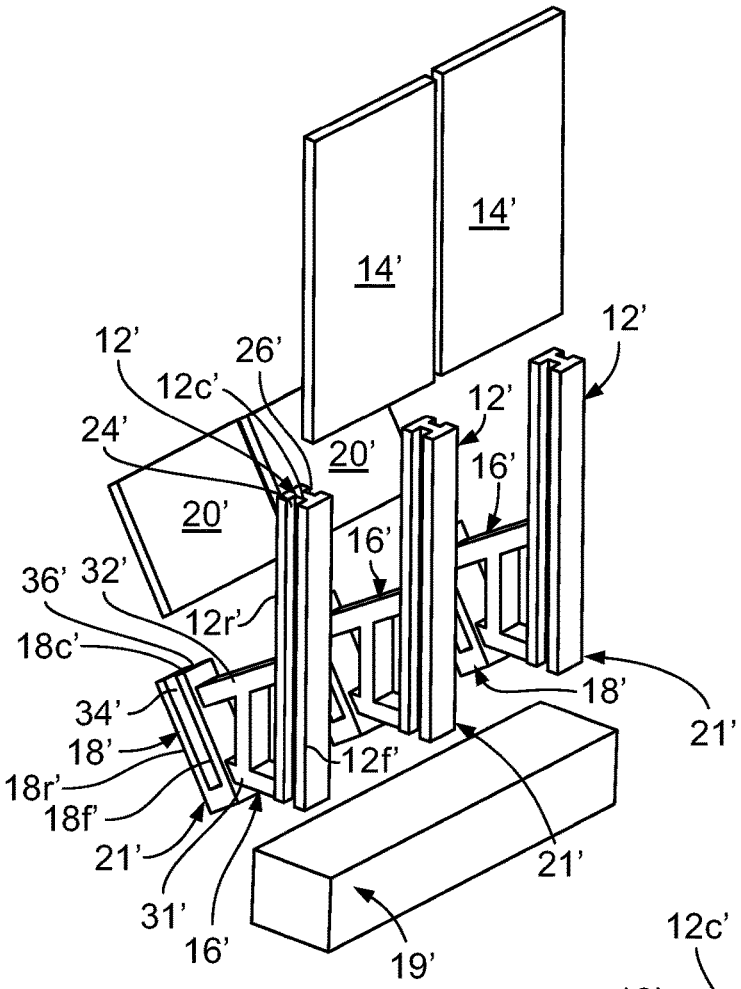
FIG. 3 is an exploded perspective view illustrating components of a system for forming a retaining wall having a shorter height than the retaining wall of FIG. 1.
Figure 4:
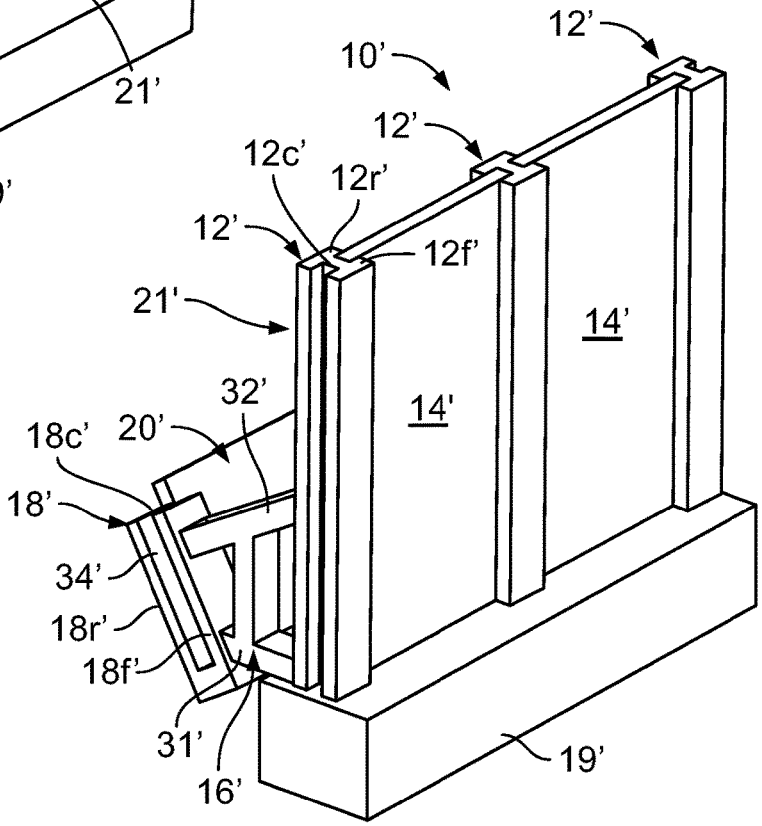
FIG. 4 is a front perspective view of an assembled retaining wall using the system of FIG. 3.

FIGS. 3 and 4 illustrate an embodiment comprising a shorter retaining wall 10' than the retaining wall 10 of FIGS. 1 and 2, wherein elements of FIGS. 3 and 4 corresponding to elements described with reference to FIGS. 1 and 2 are labeled with the same reference numerals primed. The retaining wall 10' includes framing posts 12' having a shorter length than framing posts 12, wherein the framing posts 12' are preferably supported on a footer 19', and may be configured to support a single wall panel 14' within slot areas 24', 26'. The side frames 16' can extend rearward a shorter distance and can have a reduced height, i.e., a reduced distance between lower and upper sides 31', 32', compared to the side frames 16 described for the retaining wall 10 of FIGS. 1 and 2. The side frames 16' support anchor frames 18' that include elongated slot areas 34', 36' for receiving anchor panels 20'.

As described for the embodiment of FIGS. 1 and 2, the framing posts 12', side frame 16', and anchor frame 18' form a framing post assembly 21'. Further, the slot areas 24', 26' in the framing posts 12' are defined as slots having a front side **12*f'* and a rear side 12*r'* connected by a central web 12*c'*, i.e., comprising "closed" slots, forming an I-beam configuration for the framing post 12', although other configurations of the slot areas 24', 26' may be provided. The slot areas 34', 36' in the anchor frame 18' may be defined as slots having a front side 18*f'* and a rear side 18*r'* connected by a central web 18*c'*, i.e., comprising "closed" slots, forming an I-beam configuration for the anchor frame 18', although other configurations of the slot areas 34', 36'** may be provided.

Figure 5:
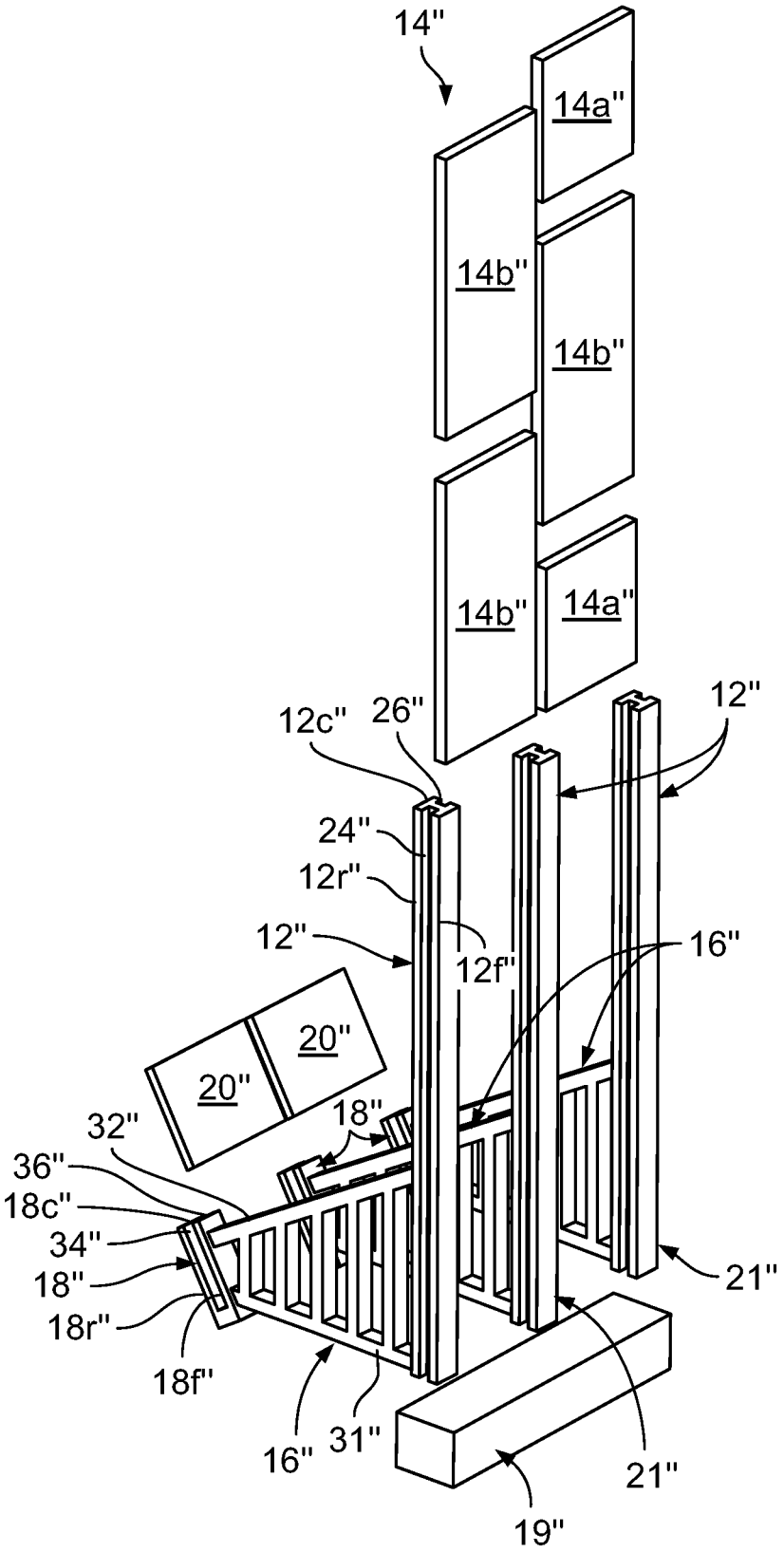
FIG. 5 is an exploded perspective view illustrating components of a system for forming a retaining wall having a greater height than the retaining wall of FIG. 1.
Figure 6A:
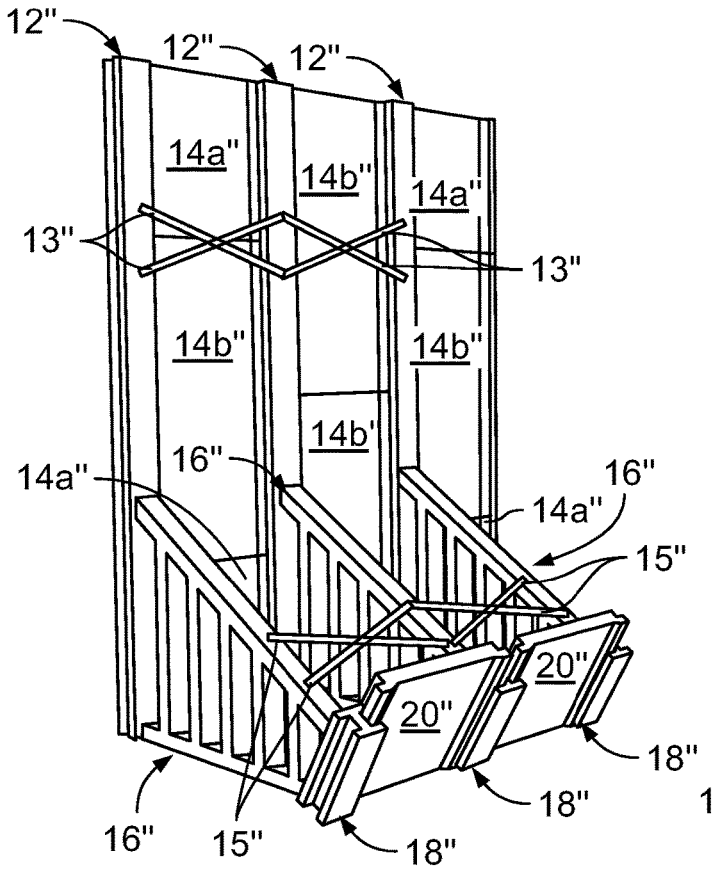
FIG. 6A is a rear perspective view of the assembled retaining wall of FIG. 6.
Figure 6:
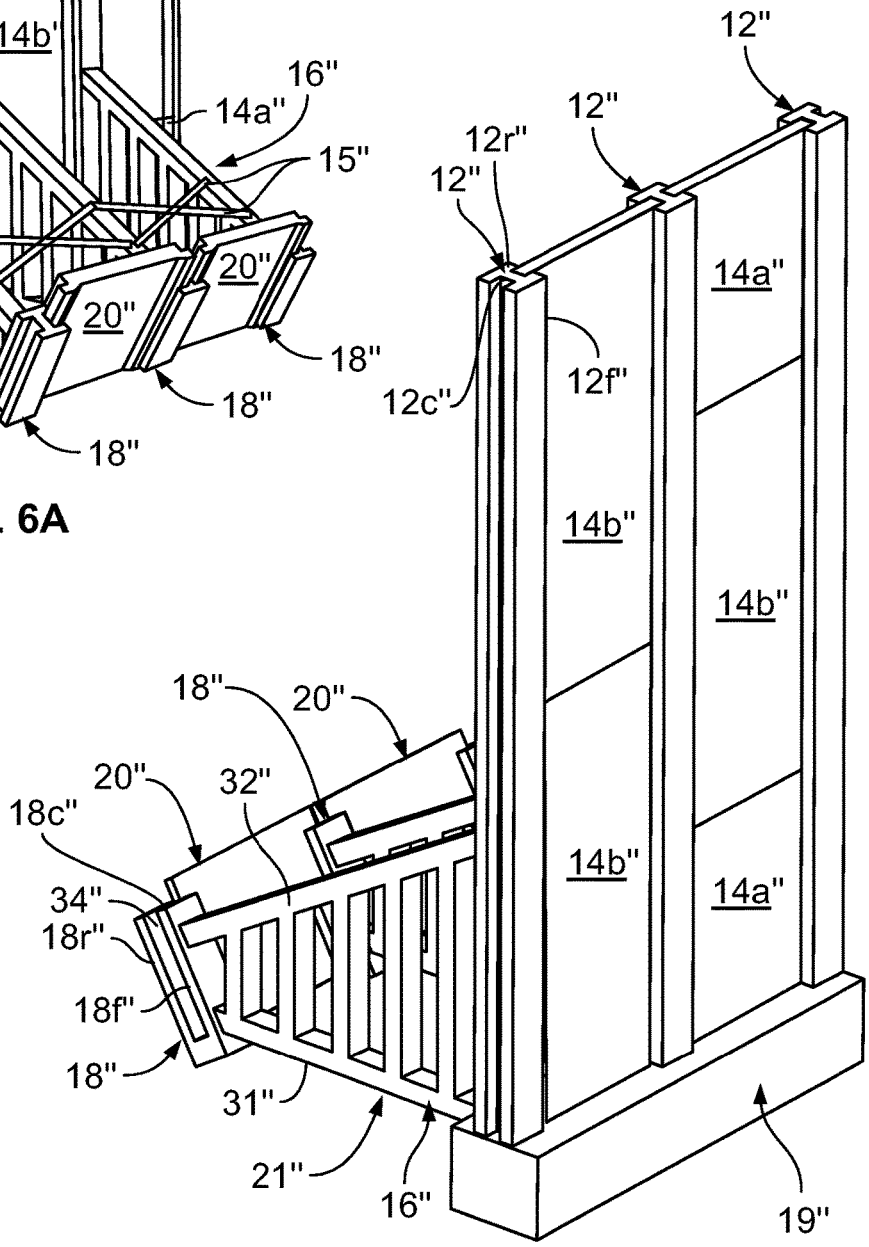
FIG. 6 is a front perspective view of an assembled retaining wall using the system of FIG. 5.

FIGS. 5 and 6 illustrate an embodiment comprising a taller retaining wall 10" than the retaining wall 10 of FIGS. 1 and 2, wherein elements of FIGS. 5 and 6 corresponding to elements described with reference to FIGS. 1 and 2 are labeled with the same reference numerals double primed. The retaining wall 10" includes framing posts 12" having a greater length than framing posts 12, wherein the framing posts 12", are supported on a footer 19", and may be configured to support a plurality of wall panels 14", including different length wall panels **14*a"*, 14*b"*, within slot areas 24", 26". The side frames 16" can extend rearward a greater distance and can have a greater height, i.e., a greater distance between lower and upper sides 31", 32" compared to the side frames 16 described for the retaining wall 10 of FIGS. 1 and 2. The side frames 16" support anchor frames 18" that include elongated slot areas 34", 36" for receiving anchor panels 20"**.

As described for the embodiment of FIGS. 1 and 2, the framing posts 12", side frame 16", and anchor frame 18" form a framing post assembly 21". Further, the slot areas 24", 26" in the framing posts 12" are defined as slots having a front side **12*f"* and a rear side 12*r"* connected by a central web 12*c"*, i.e., comprising "closed" slots, forming an I-beam configuration for the framing post 12", although other configurations of the slot areas 24", 26" may be provided. The slot areas 34", 36" in the anchor frame 18' may be defined as slots having a front side 18*f"* and a rear side 18*r"* connected by a central web 18*c"*, i.e., comprising "closed" slots, forming an I-beam configuration for the anchor frame 18", although other configurations of the slot areas 34", 36" may be provided, FIG. 6A illustrates a rear perspective view of the assembled retaining wall of FIG. 6. As seen in FIG. 6A, construction of a retaining wall structure as described herein may include use of bracing straps 13" between adjacent framing posts 12" and/or bracing straps 15" between adjacent side frames 16". The bracing straps 13", 15" can maintain a preset spacing between the framing posts 12" and the side frames 16", respectively, during construction of the retaining wall. Further, it may be understood that the bracing straps 13", 15"** may be incorporated into any of the other configurations of the retaining wall described herein.

Figure 7:
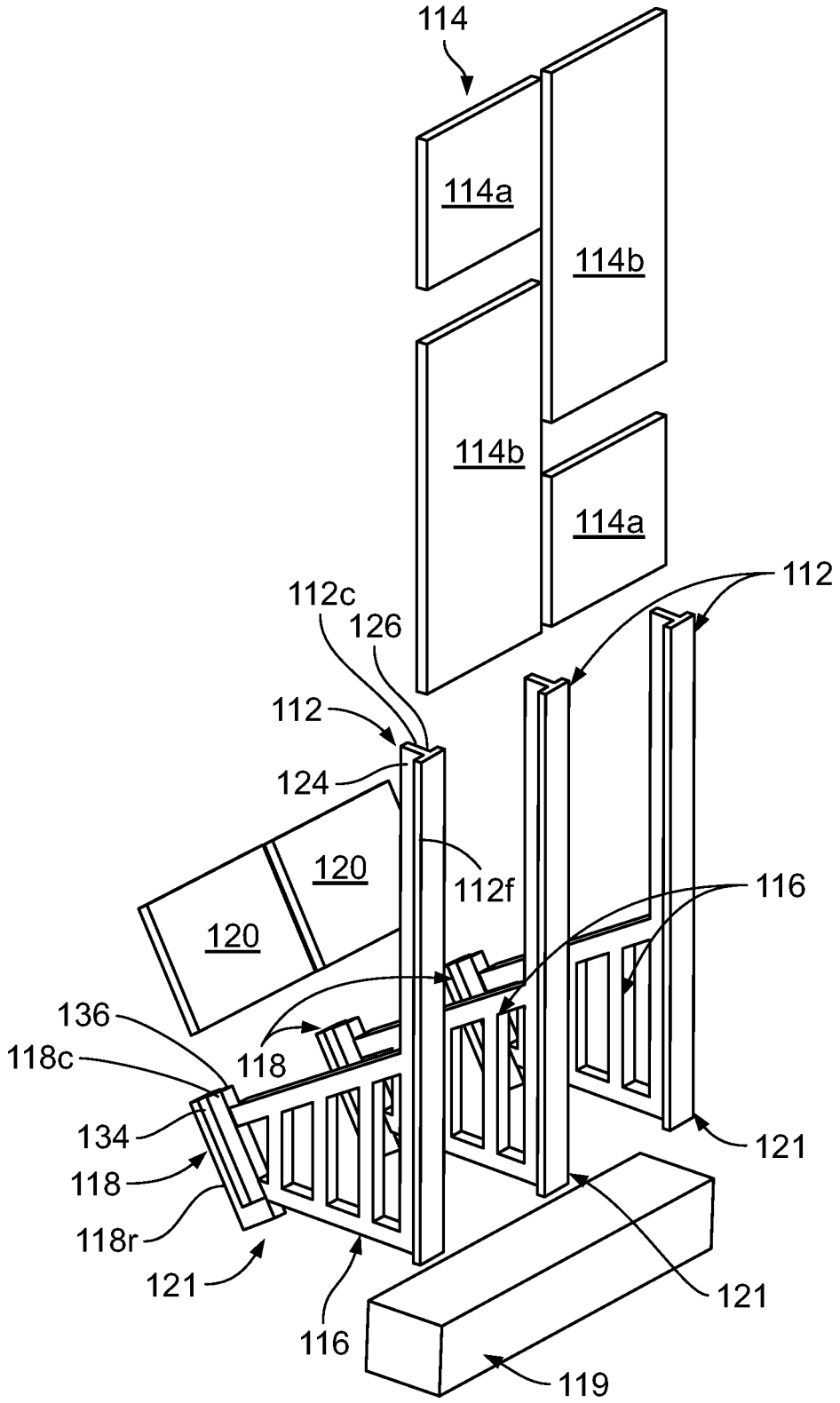
FIG. 7 is an exploded perspective view illustrating components of a system for forming a retaining wall utilizing an alternative framing post configuration.
Figure 8:
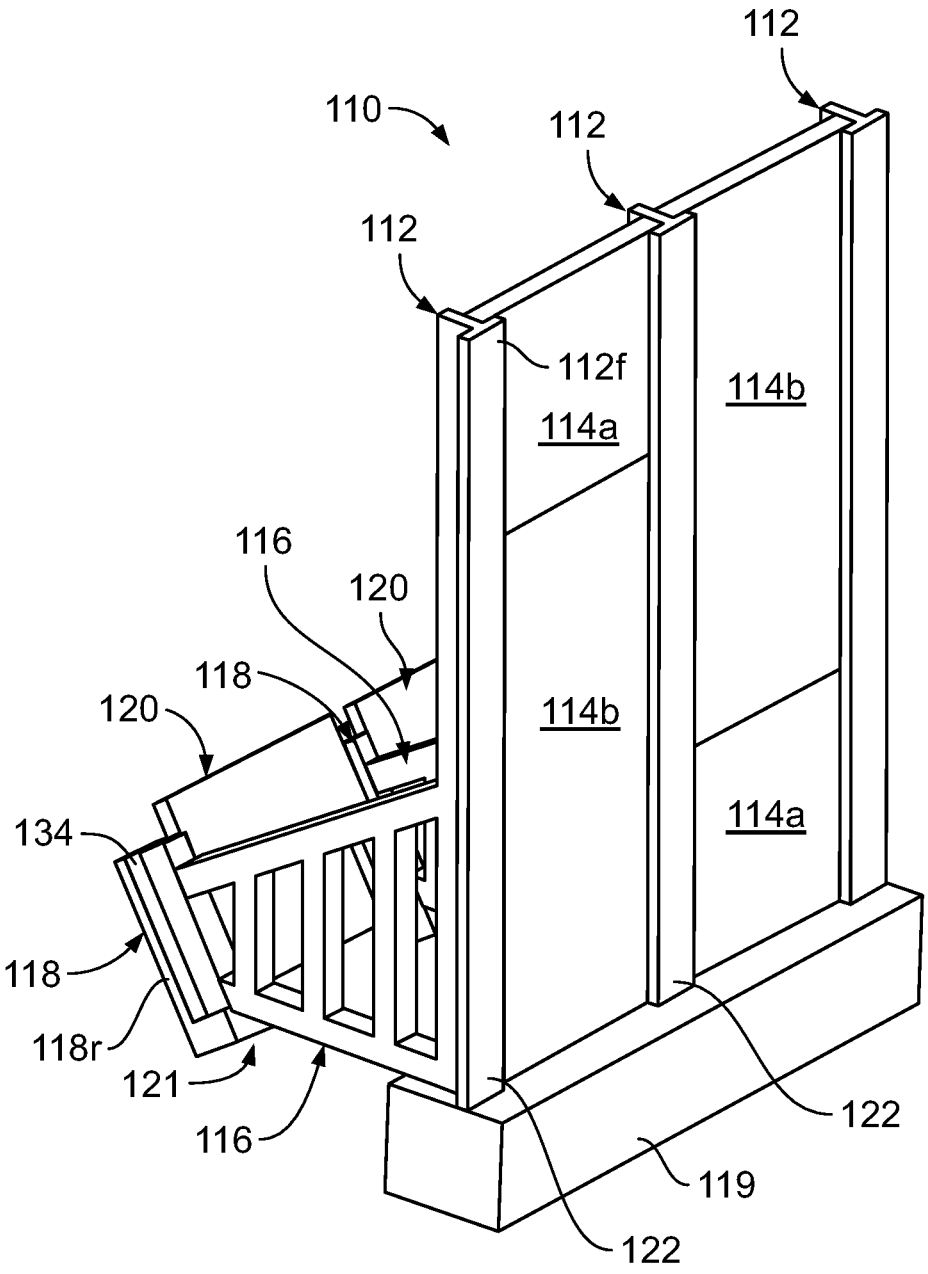
FIG. 8 is a front perspective view of an assembled retaining wall using the system of FIG. 7.

Referring to FIGS. 7 and 8, an alternative embodiment of a retaining wall 110 is illustrated, wherein elements of FIGS. 7 and 8 corresponding to elements described with reference to FIGS. 1 and 2 are labeled with the same reference numerals increased by 100. The retaining wall 110 includes framing posts 112, wherein each framing post 112 can include or is connected to a side frame 116. The side frame 116 supports an anchor frame 118 at an end of the side frame 116 distal from the framing post 112. The anchor frame 118 is configured to support an anchor panel 120. The framing post 112, side frame 116, and anchor frame 118 form a framing post assembly 121.

The framing posts 112 include slot areas 124, 126 that are defined by a front side **112*f* connected to a rearward extending central web 112***c*, i.e., comprising "open" slots, having open rear sides to form the framing posts 112 with a T-beam configuration for receiving one or more wall panels 114, e.g., wall panels 114*a*, 114*b*. Similarly, the anchor frames 118 can include similarly configured slot areas 134, 136 that are defined by a rear side 118*r* connected to a forward extending central web 118*c*, i.e., comprising "open" slots, that include open front sides to form the anchor frames 118 with a T-beam configuration for receiving anchor panels 120. The slot areas 124, 126 and/or 134, 136 may optionally be provided with brackets (not shown) or similar retention structure at the open side of the slot areas 124, 126 and/or 134, 136 sufficient to retain the wall panels 114 and/or anchor panels 120 in position during erection and prior to backfilling.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A retaining wall comprising:

at least first and second vertically extending framing posts laterally spaced from each other, each framing post including an edge defining an elongated slot area;

a side frame extending from a rear side of each framing post;

an anchor frame attached to an end of each side frame distal from a respective framing post, each anchor frame including an edge defining an elongated slot area;

at least one wall panel extending between adjacent framing posts, each wall panel including opposing lateral edges, each lateral edge of the at least one wall panel slidably located in a slot area of a respective framing post; and an anchor panel extending between adjacent anchor frames, each anchor panel including opposing lateral edges, each lateral edge of the anchor panel slidably located in a slot area of a respective anchor frame, wherein the slot areas in the anchor frames are defined by a front side and a rear side connected by a central web to define an I-beam configuration for the slot areas of the anchor frames slidably receiving the lateral edges of the anchor panel.

2. The retaining wall of claim 1, wherein each side frame includes a lower side and an upper side, and the anchor panel is supported to angle outwardly from the framing posts as the anchor panel extends in an upward direction from the lower side to the upper side of a respective side frame.

3. The retaining wall of claim 1, wherein the slot areas in the framing posts are defined by a front side and a rear side connected by a central web to define an I-beam configuration for the slot areas of the framing posts slidably receiving the lateral edges of the at least one wall panel.

4. The retaining wall of claim 1, wherein the slot areas in the framing posts are defined by a front side connected to a rearward extending central web to define a T-beam configuration for the slot areas of the framing posts slidably receiving the lateral edges of the at least one wall panel.

5. The retaining wall of claim 1, wherein each side frame is formed integrally with a respective framing post.

6. The retaining wall of claim 5, wherein each side frame and respective framing post are formed as a unitary concrete structure.

7. The retaining wall of claim 1, wherein each side frame is detachably attached to a respective framing post.

8. The retaining wall of claim 1, wherein each side frame and each framing post are formed as a steel structure.

9. The retaining wall of claim 1, wherein each side frame and each framing post are formed of a composite material.

10. The retaining wall of claim 1, wherein the side frames and framing posts are formed of different materials.

11. The retaining wall of claim 10, wherein the different materials comprise two or more of concrete, steel, and a composite material.

* * * * *